United States Patent [19]

Mueller

[11] 4,040,606

[45] Aug. 9, 1977

[54] LIQUID REACTION VESSEL WITH MEANS FOR REMOVING DEPOSITS ON ITS INNER WALLS

[75] Inventor: Rudolf Mueller, Berlin, Germany

[73] Assignee: Schering Aktiengesellschaft, Berlin & Bergkamen, Germany

[21] Appl. No.: 481,240

[22] Filed: June 20, 1974

[30] Foreign Application Priority Data

June 21, 1973 Germany ..... 2331993

[51] Int. Cl.[2] ..... B01F 7/16; B08B 3/00; B08B 9/00

[52] U.S. Cl. ..... 259/107; 259/122; 134/168 R; 134/169 R

[58] Field of Search ..... 259/16, 23, 24, 33, 259/43, 44, 96, 7, 8, 107, 108; 134/150, 166 R, 167 R, 168 R, 169 R; 239/219, 220, 221, 380; 416/87, 142, 208

[56] References Cited

U.S. PATENT DOCUMENTS

| | | | |
|---|---|---|---|
| 695,974 | 3/1902 | Wallerstein et al. | 259/107 X |
| 1,835,284 | 12/1931 | Crowhurst | 416/142 |
| 2,000,720 | 5/1935 | Snyder et al. | 239/221 |
| 2,647,527 | 8/1953 | Butler | 239/220 |
| 3,111,954 | 11/1963 | Duncan | 134/169 R |
| 3,139,100 | 6/1964 | Griparis | 134/169 |
| 3,656,974 | 4/1972 | Mihalyi et al. | 416/87 X |

FOREIGN PATENT DOCUMENTS

| | | | |
|---|---|---|---|
| 233,478 | 4/1960 | Australia | 134/168 R |

*Primary Examiner*—Edward L. Roberts
*Assistant Examiner*—Robert Pous
*Attorney, Agent, or Firm*—Millen & White

[57] ABSTRACT

Means for removing deposits formed due to foaming, etc., on the inner walls of a liquid reaction vessel which contains agitating means. Dispersing means are provided attached by arm means to the shaft of the agitator, which are adapted to engage the surface of the reaction mixture, and on increased rotation of said agitator shaft will spray or fling liquid reaction mixture onto said inner walls. The dispersing means can be curved tubular members, channel members, angled plates, paddles, etc. In one embodiment, the dispersing member is spring-biased, normally not engaging said liquid surface, and which will engage said liquid surface upon increased rotational speed.

9 Claims, 5 Drawing Figures

LIQUID REACTION VESSEL WITH MEANS FOR REMOVING DEPOSITS ON ITS INNER WALLS

BACKGROUND OF THE INVENTION

This invention relates to an apparatus for the removal of deposits on the internal walls of closed reactor vessels, the deposits are on the walls, above the level of a liquid reaction mixture, which is agitated by an agitator.

Chemical syntheses are frequently conducted in closed reaction vessels in order to avoid any contamination from outside sources as much as possible. Thus, for example, catalyzed processes are frequently conducted with the exclusion of air, and microbiological processes are conducted under sterile conditions. In the latter case, the substrate is reacted in a suitable reactor with the microorganisms under otherwise sterile conditions. In many cases, air is introduced to a certain extent in conducting the reaction under agitation. Because of substances present in the nutrient solution or substances formed by metabolic processes, the reaction mixture foams to some degree. The foam carrying microorganisms and substances out of the liquid deposits above the level of the reaction mixture on the inner walls and also on the inner surface of the lid of the reactor. The use of defoaming agents to avoid the foaming is not usually feasible because the defoamers are not suitable to be used in some cases and in most cases they exert a negative effect on the microbiological reactions. The deposits on the walls of the reactor above the liquid level make it almost impossible to conduct the process with precision, and thus in a reproducible manner, the reason being that the reaction which takes place in the deposited substance does not proceed similarly as it does in the reaction mixture. Thus, the samples withdrawn from the reaction mixture for analytical determination purposes do not take into account the deposits.

The mechanical removal of the foam, for example by the use of a scraper through the reactor lid, presents problems insofar as the sealing of the reaction vessel is concerned and thereby, for example, the sterility of the reaction mixture cannot be preserved.

A conventional device for preventing the deposits comprises the addition of a rinsing liquid. In practice, peepholes are provided to determine the formation of the deposits, but this procedure has the disadvantage of strongly diluting the reaction mixture and thus presents uncontrollable reaction conditions.

BRIEF SUMMARY OF THE INVENTION

Therefore, the main object of this invention is to provide a novel device usable on the agitator shaft in a closed reactor, which reintroduces periodically, back into a reaction mixture, portions of the reaction mixture which have become deposited on the walls above the level of the reaction mixture and on the inner surface of the lid.

According to the invention, the object is accomplished by providing dispersing means disposed on the agitator shaft at the liquid level surface which, when the rotational speed of the agitator shaft is increased in relation to the normal agitation speed flings the liquid reaction mixture from the surface thereof onto the inner walls and the inside of the lid of the reactor.

The apparatus of this invention is suitable for use with all reaction vessels of the closed type, wherein deposits occur on the side walls or on the inner surface of the lid above the liquid level by frothing or rolling of the liquid caused by reaction therein. The apparatus is particularly useful, for example, in microbiological methods wherein sterile conditions are necessary, wherein increased foaming occurs, and wherein the ratio of free wall surface to the quantity of liquid is relatively large, such as in reactors of up to 5000 liters, for example, fermenter reactors.

The dispersing means, as disclosed herein, can comprise various suitable specific embodiments. The dispersing means are attached to the agitator shaft and have their lower ends or edges immersed in the surface of the liquid reaction mixture. The dispersing means can include one or more curved tapering pipes with a larger lower opening, troughs or channels, and spoon shaped paddles or inclined plates.

A particular specific embodiment comprises dispersing means attached to the agitator shaft and movable into or out of the surface of the liquid mixture in relation to the rotational speed of the agitator shaft. With this embodiment, it is possible to control the amount or guide the jets of liquid dispersed onto the inside wall to a desired distance above the liquid level.

Other and further objects of the invention will become apparent in the following detailed description of the preferred embodiments of the invention taken in conjunction with the accompanying drawings.

DETAILED DESCRIPTION OF THE INVENTION

Figure 1:
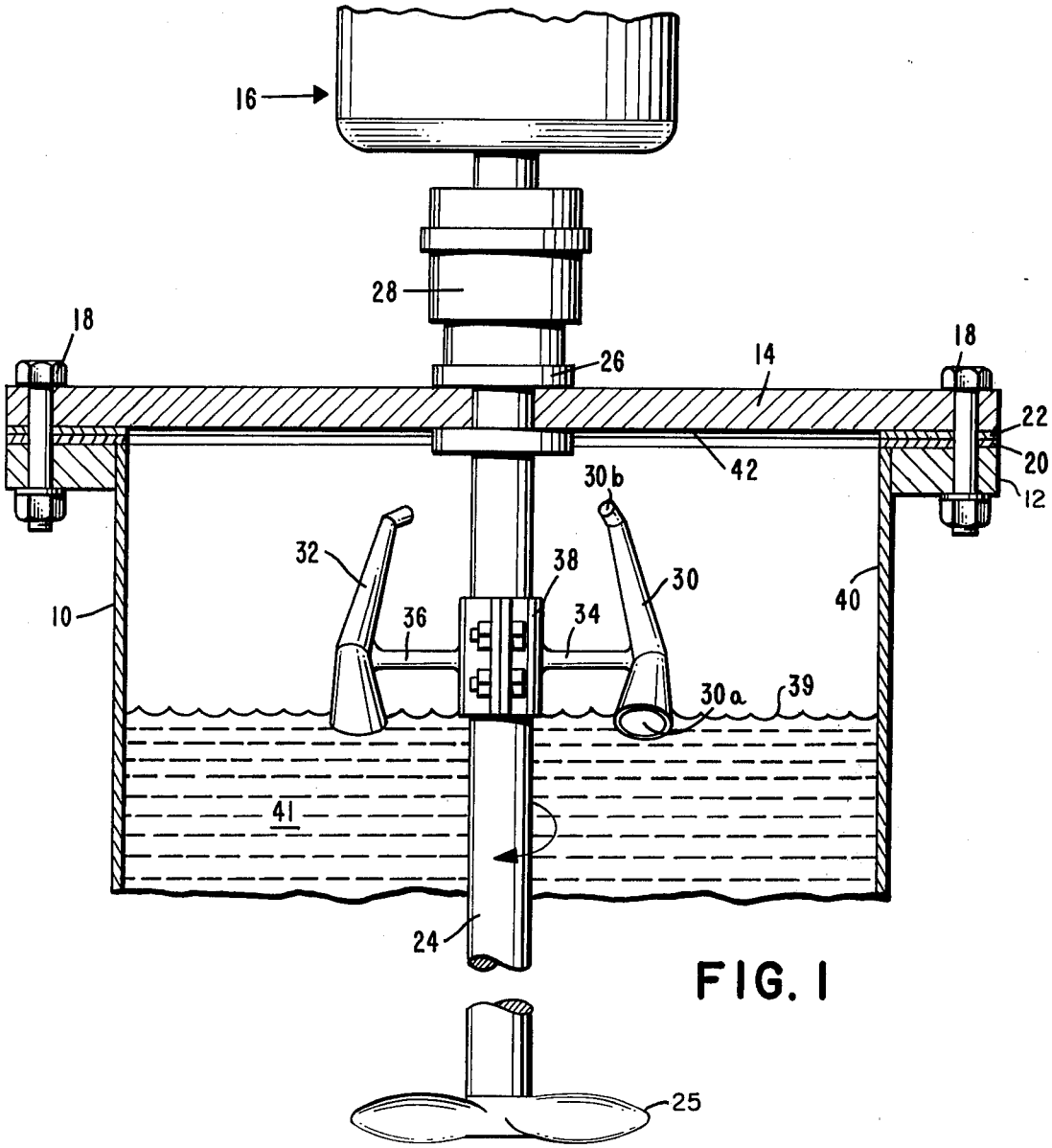
FIG. 1 is a side elevational view of a reaction vessel, partially in section, showing one embodiment of the invention.
Figure 2:
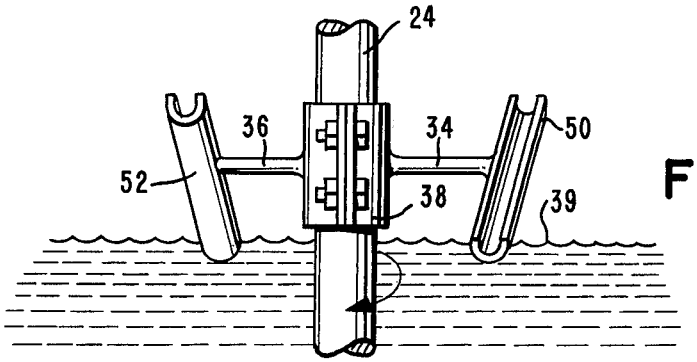
FIGS. 2, 3, 4 and 5 are side elevational view of four additional embodiments of the invention, which are disposed within a reaction vessel (not shown) similarly as the embodiment in FIG. 1.
Figure 3:
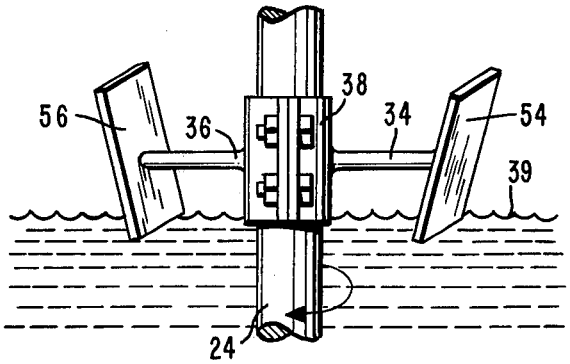
Figure 4:
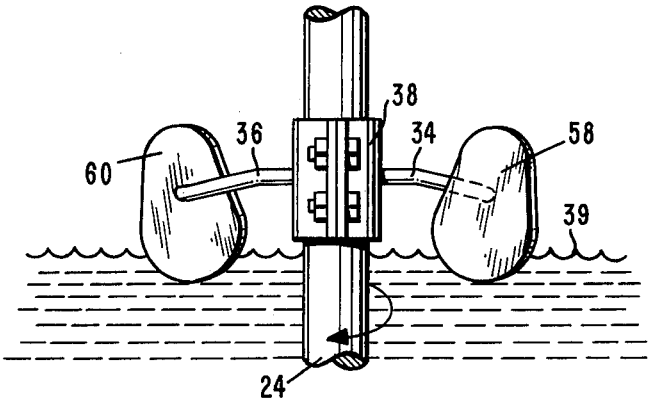

FIG. 1 of the drawings depicts a typical closed reactor vessel 10 which comprises peripheral flange means 12, a closure lid 14, and agitating means generally designated by the numeral 16 disposed through said lid. The lid 14 is conventionally secured and sealed to the vessel 10 by nut and bolt means 18, or other suitable means, through suitable holes in flange 12 and the lid 14, and sealing means 20 and 22 on said flange and lid, respectively.

The agitating means 16 comprises a rotatable agitator shaft 24 which passes through lid 14 through conventional sealed bearings 26. The agitator 24 is driven by a suitable motor 28, extends into the reaction mixture, and can be provided with suitable agitating means such as paddles, etc. 25.

Attached to the shaft 24 are two curved, tapering pipes 30 and 32 which are composed of four segments of decreasing diameters, but which can also be one curved tapering pipe. The pipes are attached to the agitator shaft 24 by means of arms 34 and 36 respectively. The arms are connected to sleeve means 38 suitably attached to shaft 24 which can be adjustably secured up or down thereon. The larger opening, such as 30*a,* of the pipes dips into the surface 39 of the liquid reaction mixture 41. The immersion depth of the end of the pipe is adjusted so that the end 30*a* of the pipe is still immersed in the liquid level at the end of the reaction, even if the level of the liquid has dropped due to the withdrawal of samples or due to liquid losses. The smaller opening 30*b* of the pipe is directed towards the inner wall 40 and inner surface 42 of the lid.

Normally, the rotational speed of the shaft 24 (as shown by the arrow) is at a speed sufficient to agitate the reaction mixture suitable for reaction purposes and liquid is not sprayed onto the walls. However, when frothing occurs and deposits are formed on the inner walls 40 and/or the inner surface 42 of the lid, the rotational speed of the shaft is sufficiently increased and liquid is directly sprayed from the surface of the reaction mixture onto the inner wall 40 of the reactor vessel and/or onto the inner surface 42 of the lid. Deposits are thereby rinsed or washed off and reintroduced into the reaction mixture.

Similarly the embodiments of the dispersing means shown in FIGS. 2 through 5, operate similarly as the pipes in FIG. 1. Thus, in FIG. 2 curved channels or troughs 50 and 52 are provided; in FIG. 3, inclined plates 54 and 56 are provided; and in FIG. 4, spoon-shaped paddles 58 and 60 are provided. Each of these dispersing means is positioned to disperse, fling, or spray liquid from the surface 39 of the reaction mixture onto the inner walls 40 and/or inner surface 42 of lid 42.

Figure 5:
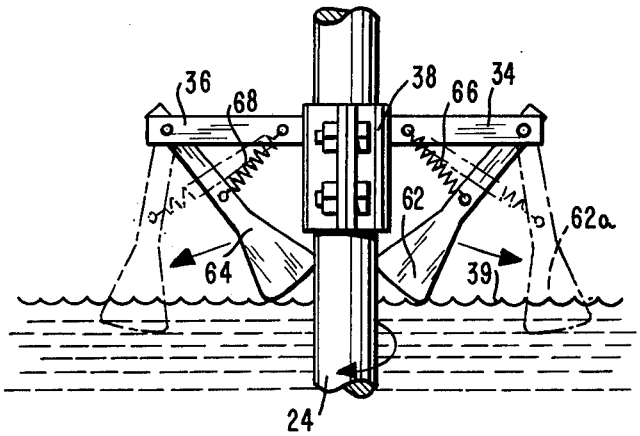

The embodiment shown in FIG. 5 comprises dispersing means adapted to be immersed in the surface of the liquid only when required for removing the deposits from the walls.

During normal rotational speed of the agitator 24, the dispersing means is not in contact with the surface zone of the reaction mixture. Thus, spoon-shaped paddles 62 and 64 are spring-biased by means of springs 66 and 68 respectively, and suitably attached between the paddles and arms 34 and 36, respectively. Upon increased rotational speed of the shaft 24, centrifugal force moves the paddles outwardly and thus into contact with the liquid zone 39 of the reaction mixture as shown in phantom. Liquid is thereby sprayed onto the walls similarly as in the previous embodiments. However, in this embodiment control of the amount of liquid sprayed or dispersed is possible, as well as the desired distance up on the wall 40 and/or onto the inner surface 42 of the lid. Control is accomplished by the rotational speed of the shaft 24 which permits a greater or lesser portion of the paddles 62 and 64 to be immersed into the surface of the reaction mixture. Although spring means are disclosed, it is contemplated that other biasing means can be used with the paddles 62 and 64.

In the above embodiments, an increase of about 10–20% of the normal agitation speed is adequate to obtain dispersement of the liquid and thereby obtain the desired rinsing effect. The dispersing and rinsing operation is repeated, as required from experience, to periodically remove the deposits. Peep-holes can also be used to determine the formation of deposits and frothing.

Accordingly, with this invention it can be seen that continuous rinsing is not necessary, which is undesirable in microbiological reactions, etc. and thus undesired and uncontrollable aeration is avoided.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A reaction vessel for containing a liquid reaction mixture at a predetermined level comprising: a closed chamber; agitating means extending into said chamber, including a rotatable shaft for agitating the liquid reaction mixture at a given rotational speed and for rotating at a higher rotational speed upon command; means for rotating said shaft at said given speed and at said higher speed; means for rinsing deposits from the inner surfaces of said chamber above said predetermined level of the liquid reaction mixture, said rinsing means including dispersing means having one end for engaging the surface of said liquid reaction mixture only during such increased rotational speed and for spraying said liquid reaction mixture on the inner surfaces of said chamber, and arm means for connecting said dispersing means to said shaft.

2. A reaction vessel for containing a liquid reaction mixture at a predetermined level comprising: a closed chamber; agitating means extending into said chamber, including a rotatable shaft for agitating the liquid reaction mixture at a given rotational speed and for rotating at a higher rotational speed upon command; means for rotating said shaft at said given speed and at said higher speed; means continuously in said vessel for rinsing deposits from the inner surfaces of said chamber above said predetermined level of the liquid reaction mixture, said rinsing means including dispersing means having one end for engaging the surface of said liquid reaction mixture and for spraying said liquid reaction mixture on the inner surfaces of said chamber only during such increased rotational speed, and arm means for connecting said dispersing means to said shaft.

3. The reaction vessel of claim 2, wherein said dispersing means comprises an open-ended, curved, tapering, tubular member having its larger opening disposed downwardly and its smaller opening towards said walls.

4. The reaction vessel of claim 2, wherein said dispersing means comprises channel members disposed at an angle with respect to said reaction mixture surface.

5. The reaction vessel of claim 2, wherein said dispersing means comprises plate means disposed at an angle with respect to said reaction mixture surface.

6. The reaction vessel of claim 1, wherein said dispersing means comprises spoon-shaped paddle means.

7. The reaction vessel of claim 1, wherein said dispersing means is biased for rotational movement on said arm means and normally does not engage said reaction mixture surface, and is adapted to engage said surface upon increased rotational speed of said shaft.

8. The reaction vessel of claim 7, wherein said dispersing means is spring biased.

9. The reaction vessel of claim 1 also including sleeve means adjustably secured to said shaft for inter-connecting said arm means to said shaft.

* * * * *